US009220992B2

(12) United States Patent
Ochi

(10) Patent No.: US 9,220,992 B2
(45) Date of Patent: Dec. 29, 2015

(54) GAME DEVICE

(71) Applicant: BLD Oriental, Co., Ltd., Izumisano Osaka Prefecture (JP)

(72) Inventor: Yasushi Ochi, Izumisano (JP)

(73) Assignee: BLD Oriental, Co., Ltd. (JP)

( * ) Notice: Subject to any disclaimer, the term of this patent is extended or adjusted under 35 U.S.C. 154(b) by 0 days.

(21) Appl. No.: 14/355,388

(22) PCT Filed: Oct. 24, 2012

(86) PCT No.: PCT/JP2012/006817
§ 371 (c)(1),
(2) Date: Apr. 30, 2014

(87) PCT Pub. No.: WO2013/069220
PCT Pub. Date: May 16, 2013

(65) Prior Publication Data

US 2014/0287651 A1 Sep. 25, 2014

(30) Foreign Application Priority Data

Nov. 11, 2011 (JP) ..... 2011-247587

(51) Int. Cl.

| | |
|---|---|
| ***A63H 29/10*** | (2006.01) |
| ***A63H 33/00*** | (2006.01) |
| ***A63H 33/40*** | (2006.01) |
| ***A63G 31/12*** | (2006.01) |

(52) U.S. Cl.
CPC ..... *A63H 29/10* (2013.01); *A63G 31/12* (2013.01); *A63H 33/00* (2013.01); *A63H 33/40* (2013.01)

(58) Field of Classification Search
CPC ..... A63G 31/12
USPC ..... 446/176, 236, 491, 237, 262, 263, 85, 446/89, 120, 124, 220–227; 248/163.2
See application file for complete search history.

(56) References Cited

U.S. PATENT DOCUMENTS

| | | | | |
|---|---|---|---|---|
| 2007/0072510 | A1* | 3/2007 | Hsu | 446/236 |
| 2008/0153382 | A1* | 6/2008 | Borg et al. | 446/220 |

FOREIGN PATENT DOCUMENTS

| | | | |
|---|---|---|---|
| JP | 663499 | U | 9/1994 |
| JP | 3055562 | U | 1/1999 |
| JP | 2002952 | A | 1/2002 |
| JP | 2002211298 | A | 7/2002 |
| JP | 200867741 | A | 3/2008 |
| WO | 2006022008 | A1 | 3/2006 |

* cited by examiner

*Primary Examiner* — Gene Kim
*Assistant Examiner* — Rayshun Peng
(74) *Attorney, Agent, or Firm* — Stevens & Showalter LLP

(57) ABSTRACT

To provide a game device capable of sending air into a bag-shaped elastic sheet, even if distance is required between a blower or other air sending means and the elastic sheet.
The present invention is a game device comprising a game device main body, an air flowpath that receives air sent by an air sending means, and an elastic sheet. The game device is characterized by the elastic sheet being formed in a bag shape that is expanded by air that is sent in from the air flowpath, and the elastic sheet being supported by the air flowpath formed using part of the frame of the game device main body.

3 Claims, 4 Drawing Sheets

(A)

(B)

GAME DEVICE

TECHNICAL FIELD

The present invention relates to a game device. Especially, this present invention relates to a game device capable of using as air flowpath with the pipe such as struts.

BACKGROUND ART

The game device with cushions such that cloth body is expanded by sending the air from blowers such as the blower into the cloth body with bag shape, is known. For example, an example of the game device (air cushion game device) with cushion is disclosed in Japanese unexamined Pat. App. Pub. No. H9-182877.

SUMMARY OF THE INVENTION

Like a game device with cushions in the above patent document, when blowing in the game device, air is blown in airtight space formed of the elastic sheet by air sending unit such as the blower. Therefore to form the game device having a part swelling by the air, for example, if blowers are directly linked to the airtight space, the blowers have to be placed near the airtight space.

Alternatively, pipes for the air flowpath are formed separately, and air can be sent via the air flowpath in airtight space. Similarly blowers have to be placed near to the airtight space because the air flowpath is usually formed using short pipes. At all events the place of the blower is limited. Furthermore, the game device having blowers outside will be employed, because the blower needs to occupy space.

Facilities have to secure the space for the blower because the blower needs to occupy space. Containers for hiding the blower have to be made because above blower needs not to be visible from a user. For the above-mentioned reason, the playground equipment maker for designing the game device would like to fit blower as much as possible inside the game device. The present invention is directed to providing the game device which can comprise air sending devices such as the blower inside the game device, in simple configuration. Furthermore, it is to provide the game facilities to place the game devices.

The present invention to solve the problem is a game device comprising a game device main body, an air flowpath that receives air sent by an air sending means, and an elastic sheet. The elastic sheet is formed in a bag shape that is expanded by air sent in from the air flowpath, and the elastic sheet is supported by the air flowpath formed using part of the frame of the game device main body. The air flowpath is formed using a pipe body frame of the game device main body, and the air can be sent to the elastic sheet by supporting a bag-shaped elastic sheet with air flowpath, and by sending the air from an air sending unit in the air flowpath for supporting the elastic sheet. Therefore, if the distance of the air sending unit such as the blower and a bag-shaped elastic sheet is required, air can be sent to the elastic sheet by elastic sheet extending the air flowpath for an air sending unit.

In above configuration, the elastic sheet expanded by air sent by a rotary pipe body can be coated to the rotary pipe body. Furthermore, the rotary pipe body can be comprised of a plurality of linear line pipe body and a central tube. The plurality of linear line pipe body can removably support between two pieces of circular ring pipes placed up and down. A central tube couples with the linear line pipe body. The elastic sheet is a strut shape sheet in which the center is passed through to the other side, and the strut shape sheet expands by air sent from a small hole formed to the linear line pipe. A specified point of the strut shape sheet inner wall and the central tube of the rotary pipe body can be connected. By configuring as above, tube-shaped sheet coating air flowpath can send air.

The rotary pipe body can be comprised of a linear line pipe body and central tube. The linear line pipe body can removably support between two pieces of circular ring pipes placed up and down. The central tube couples to the linear line pipe body, and an elastic sheet is a strut shape sheet. The strut shape sheet expands by air sent from a small hole formed to the linear line pipe. A specified point of the strut shape sheet inner wall and the central tube of the rotary pipe body can be connected.

In the above configuration, the game device main body comprises a plurality of strut pipe body which is installed on floor, a frame comprising a connecting pipe body for coupling between the plurality of struts, a floor sheet body which is airtightly placed in the upper part of the frame, and comprises a lateral member comprised on the frame side. Air can be sent to the airtight space formed of a frame, a lateral member, and floor sheet body via the strut pipe body which is air flowpath and a strut pipe body.

In the above configuration, the floor sheet body swells out by sending out air by an air sending means. A floor sheet will be moved up and down by user's jumping over the floor sheet body. The game device which can continue the interest of the user for a long time can be configured by a floor moving up and down as above. In the above configuration, the elastic sheet is a ring sheet supported to a plurality of pipe body hung down by a rotation board placed in the upper part of the strut provided in the game device main body, the air flowpath for sending air in the ring sheet can be at least one or a plurality of the pipe body.

The present invention is a game device comprising a game device main body, an air flowpath that receives air sent by an air sending means, and an elastic sheet. The elastic sheet is formed in a bag shape that is expanded by air sent in from the air flowpath, and the elastic sheet is supported by the air flowpath formed using part of the frame of the game device main body. The air flowpath is formed using a pipe body frame of the game device main body, and the air can be sent to the elastic sheet by supporting a bag-shaped elastic sheet with air flowpath, and by sending the air from an air sending unit in air flowpath for supporting the elastic sheet. Therefore, if the distance of the air sending unit such as the blower and a bag-shaped elastic sheet is required, air can be sent to the elastic sheet by elastic sheet extending the air flowpath for an air sending unit.

DESCRIPTION OF THE PREFERRED EMBODIMENT

Preferred Embodiment 1

Figure 1:
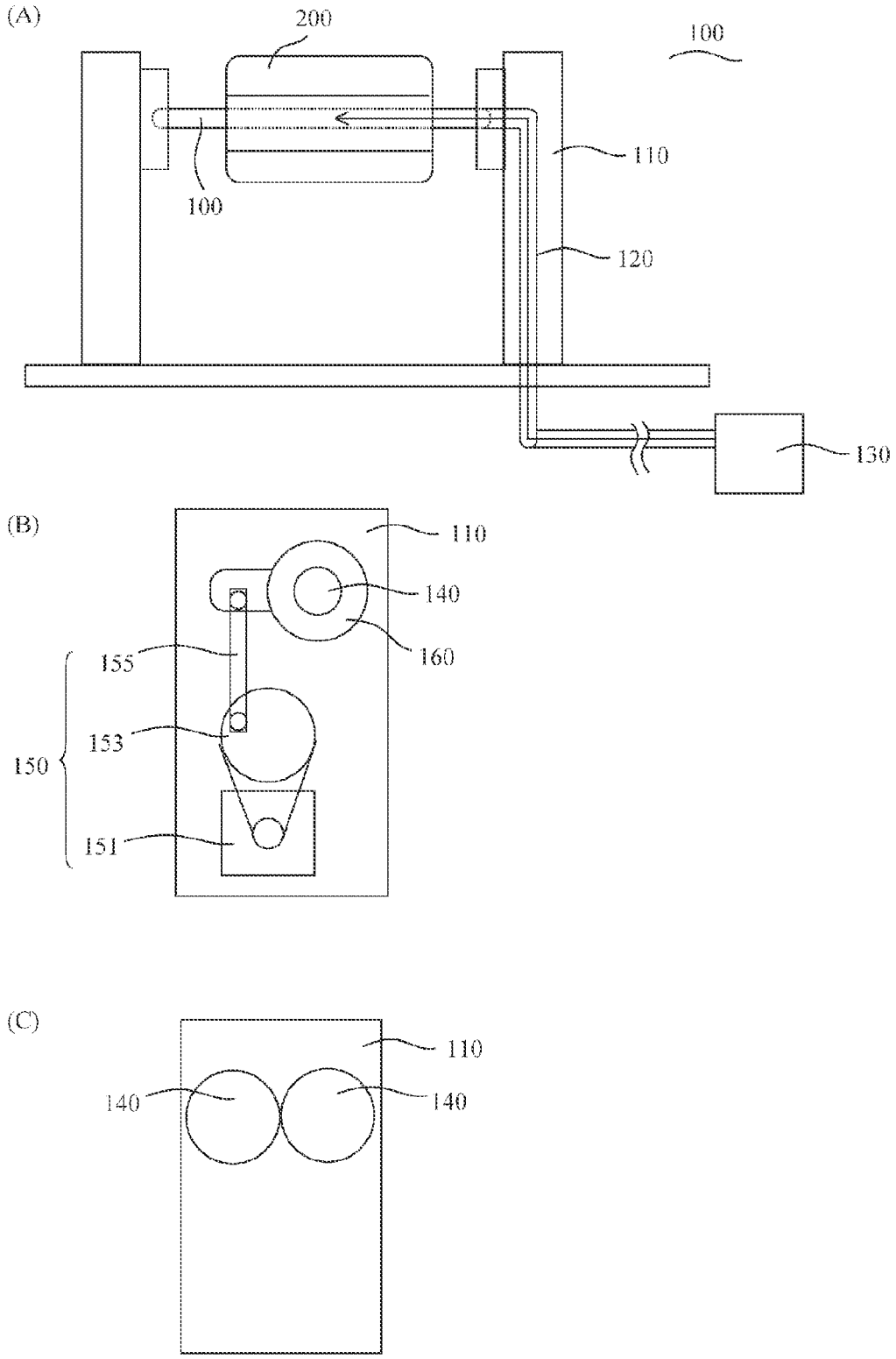
FIGS. 1(A)-(C) are front views illustrating an outlined configuration of a game device in accordance with an embodiment of the present invention.
Figure 2:
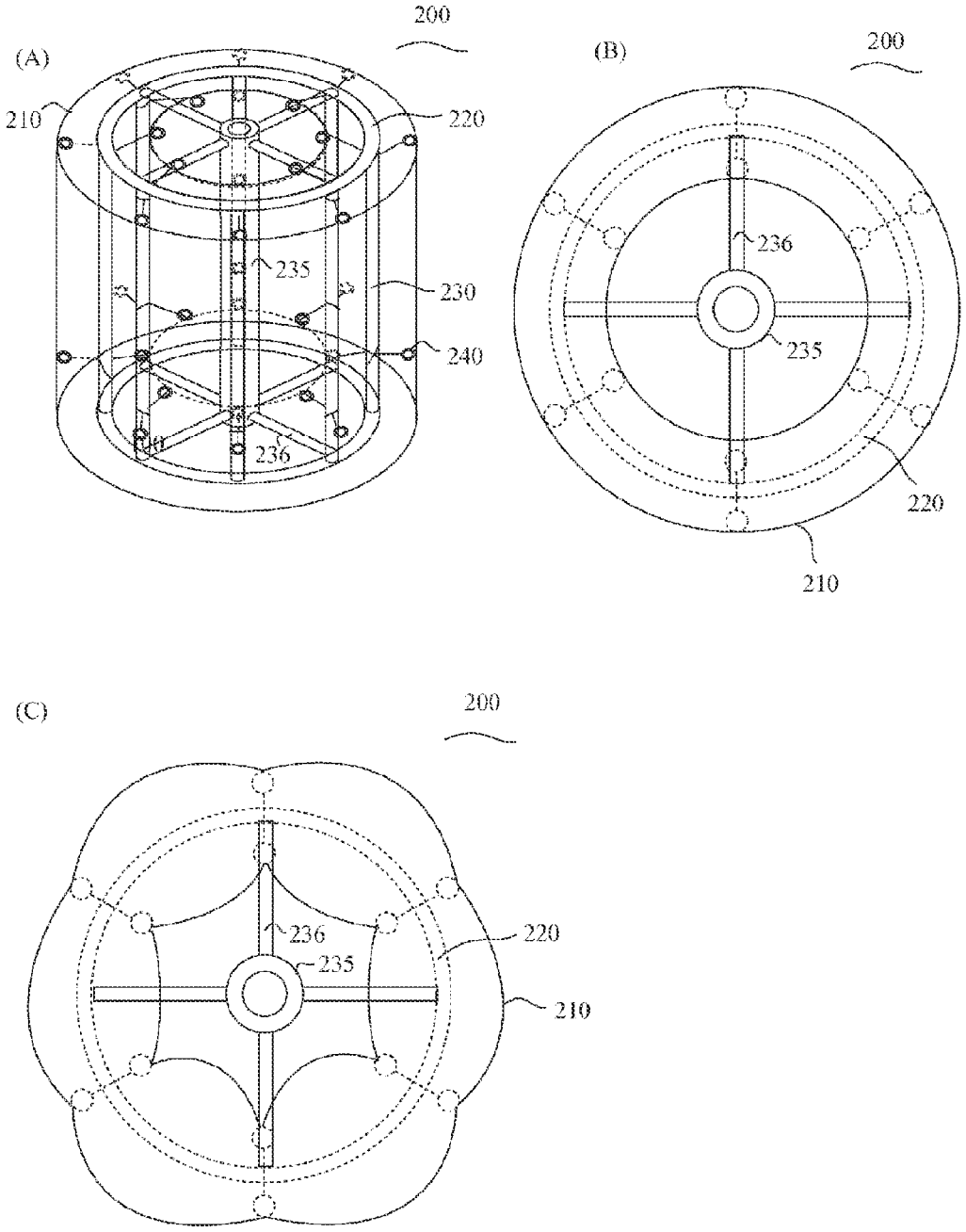
FIGS. 2(A)-(C) are a perspective view and a plan view illustrating an outlined configuration of a game device in accordance with an embodiment of the present invention.
Figure 3:
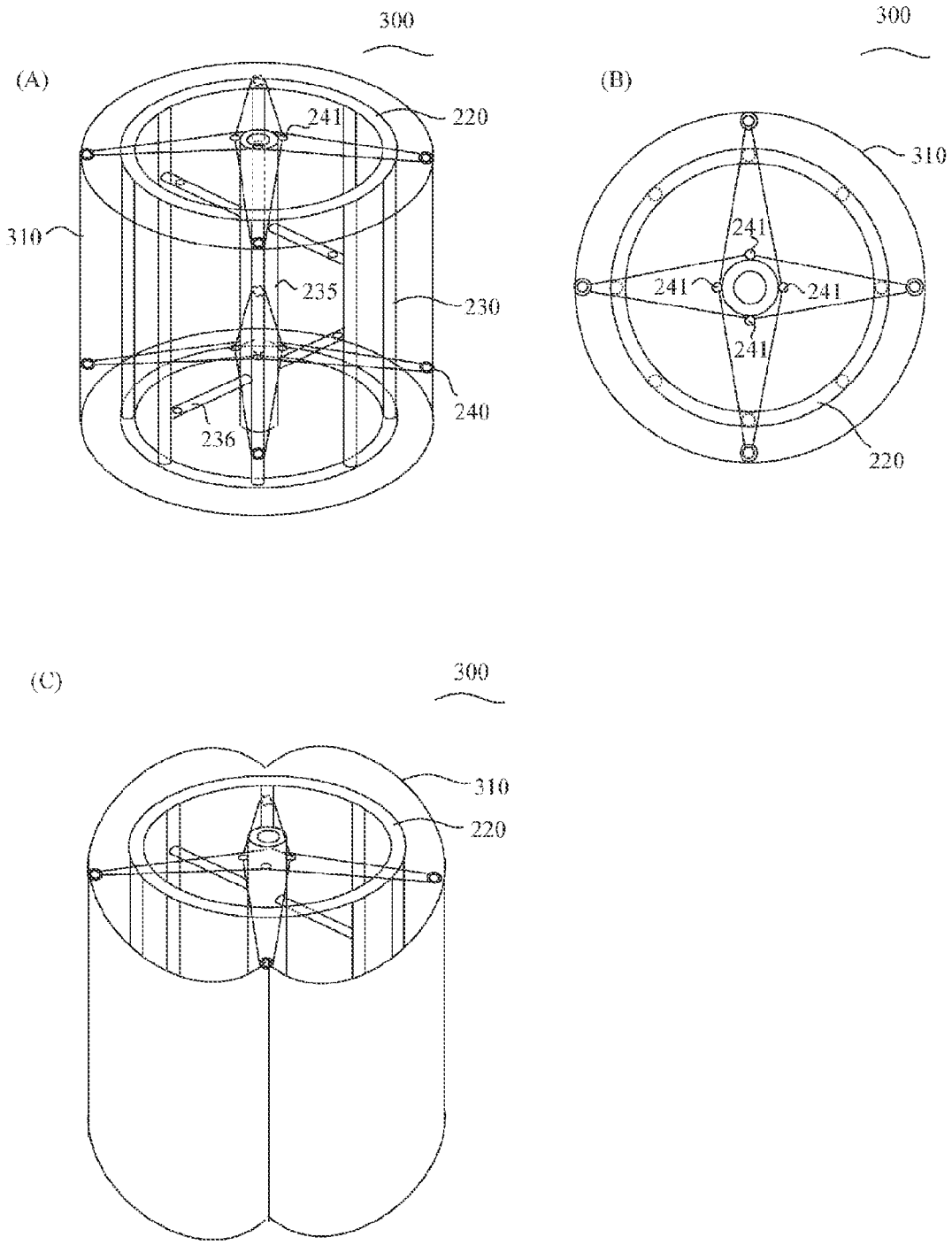
FIGS. 3(A)-(C) are a perspective view and a plan view illustrating an outlined configuration of a game device in accordance with an embodiment of the present invention.

Referring to FIG. 1, FIG. 2, FIG. 3, a game device (a rotary game device 100 in the present example) of this invention is explained. FIG. 1, FIG. 2, FIG. 3 contain outline schematic views showing the whole configuration of the game device of this invention. However, the details of the all parts which do not directly-relate to the present invention will be omitted. FIG. 1(A) is an example of a rotary game device 100 of the present example. Rotary game device 100 is formed of the elastic sheet (after-mentioned seat body 210) of the bag shape which expands by sending the air by an air sending unit such as blower 130. First, a support frame 110 is vertically arranged on floor, and a rotary tube 200 is pivotally supported to the support frame 110. An elastic sheet is coated on the rotary tube 200. Air can be blown in the elastic sheet from outside via the rotary tube 200. The rotary tube 200 has an air hole on a coated part with elastic sheet, and air is blown via the air hole. Furthermore, a flowpath 120 for leading air into the rotary tube 200 is provided. It is desirable that the above flowpath 120 is provided within the support frame 110. Note that rotary tube 200 rotates or swings by a crank mechanism 150 shown in FIG. 1 (B). For example the crank mechanism 150 can swing and rotate is a rotary trunk body 160 by giving up-and-down movement to a crank 155 provided to motor 151 shafts via a rotating plate 153 such as a sprocket. A rotary tube supporting body 140 is provided to the rotary trunk body 160, and the rotary tube supporting body 140 and the rotary tube 200 are configured to be removable. As shown in FIG. 1 (C), two rotating plates are placed horizontally, and rotary tube 200 can be configured to turn, by placing the rotary tube 200 between the two rotating plates. Of course a motor for rotating the rotating plate is provided. In this case, above rotating plate corresponding to the rotary tube supporting body 140.

Next, an example of a rotary tube 200 and an elastic sheet (seat body 210) provided to the rotary game device 100 is shown. For example, as shown in FIGS. 2 (A)-(C), the rotary_tube_200 for supporting two pieces of circular ring pipes 220 placed up and down with linear line pipe body 230 is formed. The circular ring pipe 220 and the linear line pipe body 230 is configured to be removable. A central tube 235 is placed in the center of the circular ring pipe 220, and a support member 236 fixes the circular ring pipe 220 and the central tube 235. A small hole for sending air is formed in the predetermined place of the circular ring pipe 220 and central tube 235.

Furthermore, a tube-shaped sheet is formed by bending a sheet into circle-shaped as shown in FIGS. 2(A) and (B). At this time, two pieces of tube-shaped sheets varying in the external diameter are formed. The column-shaped sheet body 210 with an opening at the center is formed when air is sent by placing the small tube-shaped sheet into the big tube-shaped sheet and by closing an edge of both tube-shaped sheets sealingly. Airtight space is formed to the sheet body 210. It is preferable that the elastic sheet forming the sheet body 210 is formed of translucent material. The rotary tube insertion opening for inserting the rotary tube 200 is formed to the sheet body 210 because rotary tube 200 is inserted in airtight space formed to the sheet body 210. Of course the insertion opening can be closed by sealing.

The rotary tube is inserted into the sheet body 210 configured as above. The rotary tube 200 and sheet body 210 is fixed to the rotary tube supporting body 140 after having inserted rotary tube 200 into the rotary tube insertion opening of the sheet body 210 because the rotary tube 200 is configured to be removable from the rotary tube supporting body 140 of crank mechanism 150. Furthermore, the rotary tube 200 and sheet body 210 can be fixed. For example, the linear line pipe body 230 and an inner wall of the sheet body 210 can be fixed via the fastening means such as chains. If air is sent, the force to expand outwardly is limited regarding the part secured to the linear line pipe body 230 within the sheet body 210. Therefore, as shown in FIG. 2 (C) a convexoconcave shape can be formed by the sheet body 210.

The above sheet body 310 can be formed cylindrically. Of course the rotary tube insertion opening capable of inserting the rotary tube 200 is formed to the column-shaped sheet body 210. For example, as shown in FIG. 3 (A), the rotary tube 300 for supporting two pieces of circular ring pipes 220 placed up and down with linear line pipe body 230 is formed. The circular ring pipe 220 and the linear line pipe body 230 is configured to be removable. Central tube 235 is placed in the center of the circular ring pipe 220, and the circular ring pipe 220 and central tube 235 is fixed by the support member 236. A small hole for sending air is formed in the predetermined place of the circular ring pipe 220 and central tube 235.

The above rotary tube 300 is inserted from the rotary tube insertion opening of the column-shaped sheet body 310 and the rotary tube 300 and column-shaped sheet body 310 are fixed. In the present embodiment, the central tube 235 and an inner wall of the sheet body 310 are fixed. For example, as shown in FIG. 3 (B), each central tube fixture 240 is provided at interval of 90 degrees against the central tube 235. Furthermore, each sheet body fixture 241 is provided at interval of 90 degrees on the inner walls of the column-shaped sheet body 310. The two central tube fixtures 241 (two central tube fixtures 241 facing via central tube 235 is preferable) provided to the central tube 235 are fixed to the inner wall of the column-shaped sheet body 310. If air is sent, the force to expand outwardly is limited regarding the part secured to the central pipe body 235 in the sheet body 310. Therefore, as shown in FIG. 3 (C), a convexoconcave shape can be formed by the sheet body 310. The rotary game device 100 is configured, by setting up the sheet body 310, and the rotary tube 300, configured as above to the rotary tube supporting body 140.

Preferred Embodiment 2

Figure 4:
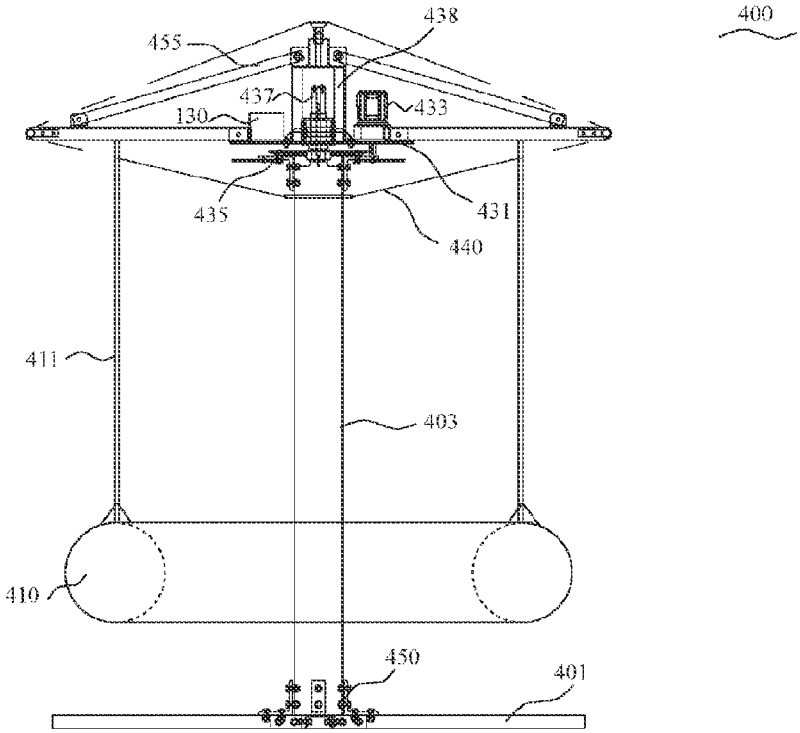
FIGS. 4(A) and (B) are a front view and plan view illustrating an outlined configuration of a game device in accordance with an embodiment of the present invention.
Figure 4:
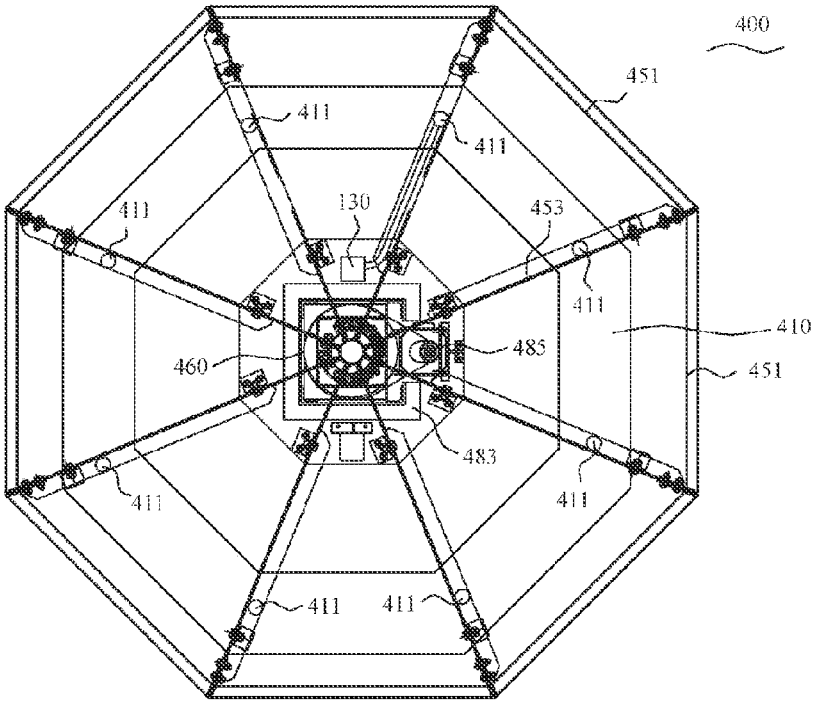

A specified embodiment of another game device is explained hereinafter with reference to the FIG. 4. FIG. 4 (A) is an outline schematic view showing whole configuration of the game device (upper part rotation type game device 400) of this invention. However, the details of the all parts which do not directly-relate to the present invention will be omitted.

The invention of the present example is a game device capable of sending the air into ring sheet 410 formed of the elastic sheet formed into doughnut form. The upper part rotation type game device 400 of the present example comprises a strut 403 vertically arranged to a base substance 401 and comprises a rotation device provided above said strut 403. First, the base substance 401 is formed. In the present embodiment, the base substance 401 of the top view cross form is formed. Of course, any shape of the base substance 401 can be employed if the base substance 401 can support after-mentioned strut 403 and rolling mechanism, A rectangular base substance 401 such as top view octagon shapes can be formed. Note that, in the present example, the base substance 401 removably couples by a coupling means 450 such as bolts and nuts. By coupling in this way, when the coupling means 450 is removed, the base substance 401 can be transported as various components configuring the base substance.

A strut 403 is stood on column fixing member (not shown) provided in center of the base substance 401. Regarding the strut 403 vertically arranged to the base substance 401, the hollow cylindrical pipe is desirable, so as to engage above rolling mechanism lower portion. A rotation device is installed in the upper formed strut 403 as formed above. As shown in FIG. 4 (A), the center of a rotary board 431 pivotally supports a toothed gear such as the sprocket. In the present embodiment, an opening is opened in the center of the rotary board 431, and a drive shaft 437 is placed in one surface (it is assumed upper side). At this case, above drive shaft 437 is placed so as to pass through from the center opening of the rotary board 431, and the sprocket is fixed in a lower portion of the drive shaft 437 to pass through from rear faces of the rotary board 431. Furthermore, a slip ring (the mechanism for transmitting electric power and signal via annular cable run and brush concentrically placed to the rotating body) is fixed to the upper portion of the drive shaft 437.

A drive motor 433 for rotating the sprocket is installed in the rotary board 431. If the rotating shaft of the drive motor 433 rotates, the sprocket rotates via the chain, and the drive shaft 437 secured to the sprocket rotates by fitting a chain 460 on the rotating shaft and the sprocket of the drive motor 433. Thereby, the rotary board 431 fixing the drive shaft 437 rotates. As described above, a rotation device of this invention is formed by configuring rotary board 431, sprocket, drive shaft 437, drive motor 433, and a chain 460. Note that, the drive shaft 437 is accommodated within a drive shaft container 438. In accordance with exemplary embodiments, a cube frame is formed as the drive shaft container 438.

The upper part rotation type game device 400 is completed by putting the rotation device configured as above on the upper portion of the strut 403. That is, the lower portion of the drive shaft 437 is fitted in the upper portion of the strut 403, and the rotation device is fixed to the upper portion of the strut 403 by supporting body such as angle-shaped iron material. Furthermore a decoration can be employed to the upper part rotation type game device 400. For example, as shown in FIG. 4 (B), an arm part 453 can be provided to the rotary board 431 of the upper part rotation type game device 400. In accordance with exemplary embodiments, the arm part 453 is installed parallel to the rotary board 431. With the condition of top view octagon shape, eight arm parts 453 are horizontally extended from the rotary board 431, with predetermined spacing, and a decoration body of the top view octagon is formed by coupling the edge of each arm part 453 with joint members 451. Above arm part 453 is supported by providing an arm part support 455 for coupling from the upper part of the drive shaft container 458 to edge of the arm part 453. Above arm part 453 is completely supported by above configuration. The arm part 453, arm part support 455 and above arm part 453 is removably connected by coupling means 450 such as bolts and the nuts. By coupling in this way, when the coupling means 450 is removed, they can be transported as various components configuring the base substance 401.

The ring sheet 410 is provided to the upper part rotation type game device 400 described above. In accordance with exemplary embodiments, ring sheet 410 of the form of top view octagon is installed to the upper part rotation type game device 400. First, a round pipe 411 hangs perpendicularly from the arm part 453 provided to the rotary board 431 of game device 400. Above round pipe 411 supports above ring seat 410. In the present embodiment, the round pipe 411 hangs down from the eight arm parts 453. Of course, when at least one or more of the round pipe 411 is connected in the air outlet of blower 130, it is used as air flowpath. In the present embodiment, above blower 130 is placed on the rotary board 431, and air from the blower 130 is blown in the ring sheet 410 via round pipe 411 used as air flowpath.

INDUSTRIAL APPLICABILITY

The present invention is a game device comprising a game device main body, an air flowpath that receives air sent by an air sending means, and an elastic sheet. The elastic sheet is formed in a bag shape that is expanded by air sent in from the air flowpath, and the elastic sheet is supported by the air flowpath formed using part of the frame of the game device main body. An air flowpath is formed using a pipe body frame of the game device main body, and the air can be sent to the elastic sheet by supporting a bag-shaped elastic sheet with air flowpath, and by sending the air from an air sending unit in air flowpath for supporting the elastic sheet. Therefore, if the distance of the air sending unit such as the blower and a bag-shaped elastic sheet is required, air can be sent to the elastic sheet by elastic sheet extending the air flowpath for an air sending unit, which makes them industrially useful.

What is claimed is:

1. A game device comprising:

a game device main body, an air flowpath comprising a rotary pipe body for receiving air sent by an air sending unit, an elastic sheet being formed in a bag shape that is expanded by air sent in from the air flowpath, and the elastic sheet is coupled to the rotary pipe body, expanded by air sent by the rotary pipe body and supported by the rotary pipe body defining part of the air flowpath and formed by part of a frame of the game device main body, wherein the rotary pipe body comprises a linear line pipe body removably supported between two pieces of circular ring pipes placed at both ends of the linear line pipe body, and a central tube connecting said linear line pipe body, and wherein the elastic sheet is a column shape sheet, the column shape sheet expands by air sent from a small hole formed in the linear line pipe.

2. The game device according to claim 1, wherein the column shape sheet comprises an open center extending through the column shape sheet.

3. The game device according to claim 2, wherein a specified point of the column shape sheet inner wall is connected to the central tube of the rotary pipe body.

* * * * *